US005806579A

United States Patent [19]

Judkins

[11] Patent Number: 5,806,579

[45] Date of Patent: Sep. 15, 1998

[54] VENETIAN TYPE BLINDS HAVING OPPOSED LIFT CORDS

[76] Inventor: Ren Judkins, 46 Newgate Rd., Pittsburgh, Pa. 15202

[21] Appl. No.: 896,469

[22] Filed: Jul. 18, 1997

Related U.S. Application Data

[63] Continuation-in-part of Ser. No. 661,192, Jun. 10, 1996, Pat. No. 5,692,552, which is a continuation of Ser. No. 384,136, Feb. 6, 1995, Pat. No. 5,573,051.

[51] Int. Cl.[6] ..... E06B 9/30

[52] U.S. Cl. ..... 160/168.1 R; 160/84.05

[58] Field of Search ..... 160/168.1 R, 170 R, 160/171 R, 172 R, 173 R, 176.1 R, 177 R, 178.1 R, 84.05

[56] References Cited

U.S. PATENT DOCUMENTS

| | | | |
|---|---|---|---|
| 262,399 | 8/1882 | Gibson et al. . | |
| 2,140,049 | 12/1938 | Grauel | 156/10 |
| 2,162,226 | 6/1939 | McKinney | 156/17 |
| 2,200,349 | 5/1940 | Walker | 156/17 |
| 2,231,778 | 2/1941 | Swanson | 156/17 |
| 2,307,278 | 1/1943 | Krantz | 160/173 |
| 2,374,591 | 4/1945 | Dunn | 160/177 |
| 2,381,060 | 8/1945 | Kahn | 160/170 |
| 2,397,765 | 4/1946 | Sylvanus | 160/168 |
| 2,401,283 | 5/1946 | Williams | 160/173 |
| 2,407,554 | 9/1946 | Isserstedt | 160/173 |
| 2,572,224 | 10/1951 | Walker | 160/173 |
| 2,573,700 | 11/1951 | Ferguson et al. | 160/173 |
| 2,576,159 | 11/1951 | Walker | 160/178 |
| 2,583,031 | 1/1952 | Walker | 160/168 |
| 2,587,756 | 3/1952 | Palmisano | 160/168.1 |
| 2,591,570 | 5/1952 | Walker | 160/178 |
| 2,632,506 | 3/1953 | Walker | 160/178 |
| 2,687,770 | 8/1954 | Walker | 160/176 |
| 2,690,215 | 9/1954 | Croxen | 160/173 |
| 2,783,831 | 3/1957 | Moyer | 160/173 |
| 3,294,153 | 12/1966 | Fountain | 160/163 |
| 3,460,601 | 8/1969 | Abraham | 160/168 |
| 4,168,735 | 9/1979 | Frei | 160/168 |
| 4,200,135 | 4/1980 | Hennequin | 160/168 |
| 4,621,673 | 11/1986 | Georgopoulos et al. | 160/168 |
| 4,651,794 | 3/1987 | Bytheway, Jr. | 160/168 |
| 4,697,630 | 10/1987 | Rude | 160/166 |
| 4,708,188 | 11/1987 | Bytheway, Jr. | 160/174 |
| 4,723,586 | 2/1988 | Spangenberg | 160/107 |
| 4,869,308 | 9/1989 | Chang | 160/176.1 |
| 4,917,168 | 4/1990 | Chen | 160/177 |
| 4,940,070 | 7/1990 | Warden | 160/176.1 |
| 5,060,709 | 10/1991 | Simon | 160/168.1 |
| 5,123,472 | 6/1992 | Nagashima et al. | 160/170 |
| 5,139,072 | 8/1992 | Marocco | 160/176.1 |
| 5,207,261 | 5/1993 | Castraz | 160/176.1 |
| 5,228,491 | 7/1993 | Rude et al. | 160/176.1 |
| 5,232,037 | 8/1993 | Fraser | 160/168.1 |
| 5,285,838 | 2/1994 | Rapp et al. | 160/168.1 |
| 5,309,974 | 5/1994 | Fraser | 160/176.1 |
| 5,341,865 | 8/1994 | Fraser et al. | 160/176.1 |
| 5,664,613 | 9/1997 | Jelic | 160/84.05 |

FOREIGN PATENT DOCUMENTS 630127 11/1949 United Kingdom .

*Primary Examiner*—David M. Purol
*Attorney, Agent, or Firm*—Buchanan Ingersoll, P.C.

[57] ABSTRACT

An improved venetian type blind has slats each slat having at least two slots along one edge of the slats and one slot on the opposite edge of the slats. A slot on one edge is not opposite a slot on the other edge. Ladders having opposite cord type rails and rungs extending therebetween, are positioned so that one rail of a ladder is outside each of the slots and connected to the bottomrail. A lift cord passes through each of the slots between the slat and the ladder rail. A tilt mechanism attached to the headrail moves the rails of the ladders together when the blind is changed from an open to closed position.

17 Claims, 10 Drawing Sheets

82
111
83
111
111
113
113
112
112
84
113
112
3
3

VENETIAN TYPE BLINDS HAVING OPPOSED LIFT CORDS

CROSS REFERENCE TO RELATED APPLICATION

This is a continuation-in-part of U.S. patent application Ser. No. 08/661,192, filed Jun. 10, 1996, now U.S. Pat No. 5,692,552 which is a continuation of U.S. patent Application Ser. No.08/384,136 filed Feb. 6, 1995, now U.S. Pat. No. 5,573,051.

FIELD OF INVENTION

The invention relates to a venetian type blind.

BACKGROUND OF THE INVENTION

Venetian type blinds have a series of slats hung on ladders which extend from a headrail to a bottomrail. In most venetian blinds a pair of lift cords is provided each having one end attached to the bottomrail and then passing through elongated holes in the slats up to and through the headrail. A cord lock is usually provided in the headrail through which the lift cords pass. The cord lock allows the user to maintain the blind in any desired position from fully raised to fully lowered.

The slats rest on rungs between rails of the ladders. The blind is in an open position when the rungs are horizontal. To close the blind one lifts one rail while allowing the other to either remain in place or be lowered. This raises one end of each rung tilting the slats. Thus, when the blind is closed there is typically tension on one rail while the other rail of the ladder is not in tension.

The rails originally used for venetian blinds consisted of a fabric tape typically from one to two inches in width. The rungs were also made of fabric strips. Conventionally, the lift cords pass through holes in the slats which were aligned between the rails and the rungs of the ladder. When the blind was closed, the fabric rails covered the holes. Consequently, there was no concern about light passing through the holes when the blind was in a closed position.

Walker in U.S. Pat. No. 2,572,224 discloses slats for a venetian type blind having a tape type ladder system and two lift cords. One lift cord passes through notches on the inside edges at one end of the slats. The second lift cord passes through notches on the outside edge of the other end of the slats. Each lift cord is positioned behind one of the tape-type ladders. Thus, at each ladder where lift cords are present there are two lift cords, one on the inside edge and the second on the outside edge of the slat. Walker does not disclose any lift mechanism inferring that a standard lift mechanism could be used. In a blind made with Walker's slats the lift cords play no role in maintaining the slats in alignment when the blinds are closed. Rather, the tape-type rungs of the ladders maintain the slats in alignment.

Very few tape type ladders are used in blinds today. Rather, the art has adopted ladders formed of cord rails having cord-type rungs between them. Typically, the rungs are multiple strands of cord. However, a single strand of cord has also been used. Frequently, a braided cord is used for the ladder rails. The conventional lift cord arrangement in which the lift cord passes through elongated holes in the slats is used. The lift cords are aligned to be between the rails of the ladders which are provided near opposite ends of the blind. When this type of blind is closed light can pass through the holes in the blind slats. This is readily apparent to anyone looking at the closed blind.

In pleated shades efforts have been made to prevent light from passing through the cord holes by making the holes to be a diameter very close to the diameter of the cord. This is not possible in a venetian type blind where the holes must be elongated to allow the slats to tilt properly.

In the venetian blinds which utilize a cord-type ladder the blinds are opened and closed by lifting or lowering one of the ladder rails relative to the other. In most blinds the lateral position of the ladder rails relative to one another remains unchanged at the headrail. Thus, there will be slack at the top of one of the ladder rails and the center of gravity shifts forward or back when the blind is tilted.

Venetian blind slats are conventionally made of aluminum, plastic or wood. Cord route holes are normally punched into the slat one at a time while the length is cut. Wood slats are usually cut to length by saws so that punching or machining of the holes is done one unit at a time. Moreover, punching of holes through wood slats sometimes causes splintering and the areas around the holes are very difficult to paint or seal from moisture penetration. After the cord holes have been drilled, lift cords are passed from the bottomrail through the cord holes to the headrail to complete the assembled blind. After the blind has been assembled in this manner it is not possible to remove the slats from the blind without removing the lift cords making it very difficult to clean the slats in the area of the route holes. Thus, it is a major task to clean or paint the slats in this type of blind. Since the lift cords pass through each slat they prevent tight closure when the blind is tilted to a closed position. Further, the route holes weaken the slats dramatically so that bending or breakage occurs more easily at the route holes.

There is a need for a venetian type blind having no holes through the slats which uses a minimum amount of lift cords and is easy to fabricate. The venetian must operate easily and the slats must maintain alignment when the blind is open and closed and most particularly when the blind is raised and lowered.

SUMMARY OF THE INVENTION

I provide a venetian type blind having a bottomrail, headrail and plurality of slats positioned therebetween. The slats are notched to form slots on their inside edge and outside edge to accommodate lift cords. At least three lift cords pass from the bottomrail to the headrail each passing through a slot on the inside edge or outside edge of each slat. At least two preferably cord-type ladders are provided to hold the slats. The lift cords are aligned such that each lift cord is between a rail of a ladder and a slot cut in the slats and there are no two lift cords directly opposite one another on either side of the slats.

A tilt mechanism to close the blind is provided within the headrail which preferably moves the rails together as the tilt mechanism lifts one rail and lowers the other rail relative to one another. Therefore, the center of gravity of the blind is in the same plane throughout the tilt range and there is always tension on the lift cords.

A tube lift may be provided for the lift cords or a cord lock can be provided within the headrail or on the cords outside of the headrail.

Other objects and advantages of the present invention will become apparent from a description of the present preferred embodiments shown in the drawings.

DESCRIPTION OF THE PREFERRED EMBODIMENTS

Figures 1, 2:
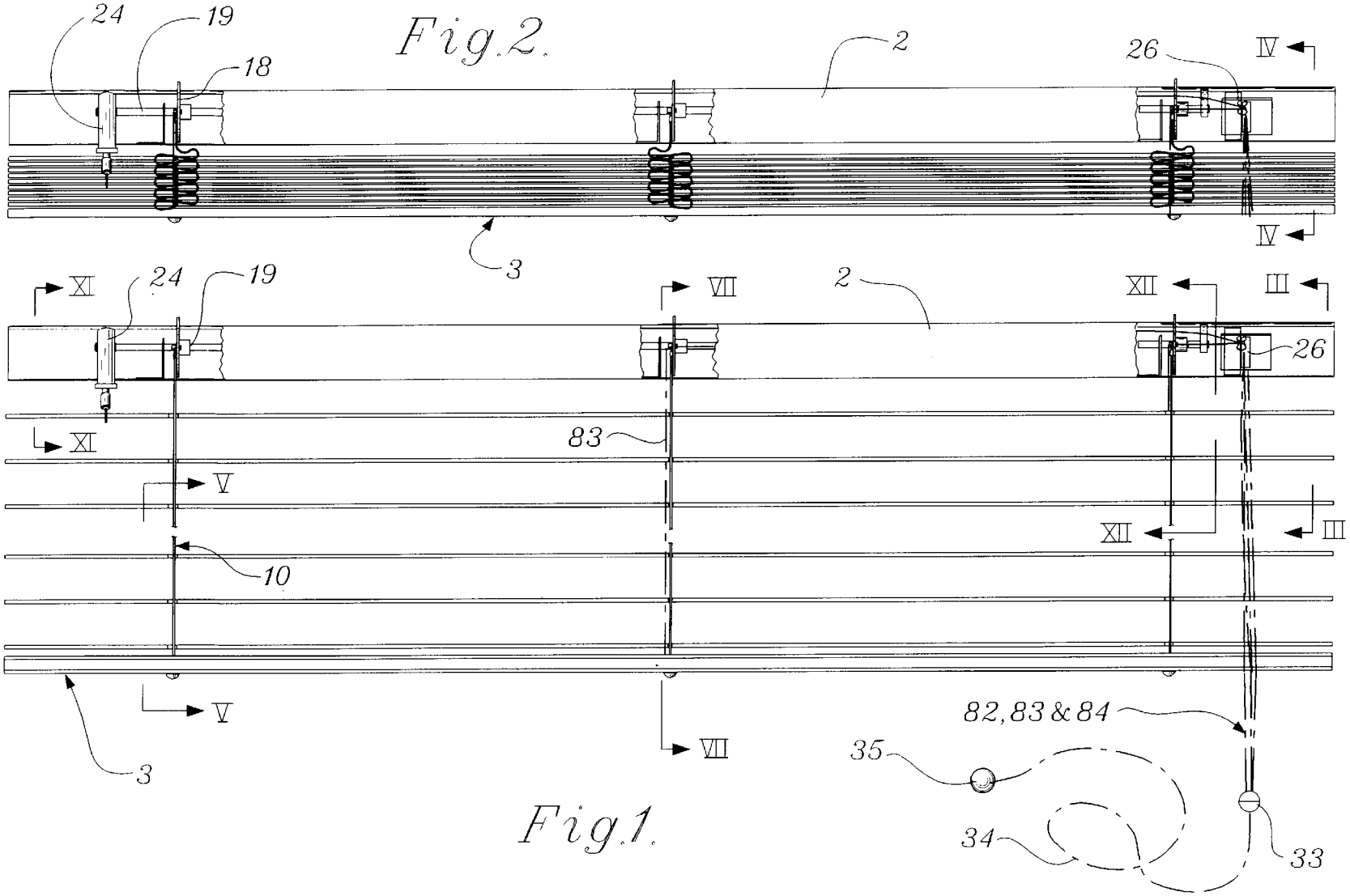
FIG. 1 is a front view of the present preferred embodiment of my venetian type blind shown in a lowered open positioned.
FIG. 2 is a front view similar to FIG. 1 showing cut-away views of the headrail when the blind in a raised position.
Figure 3:
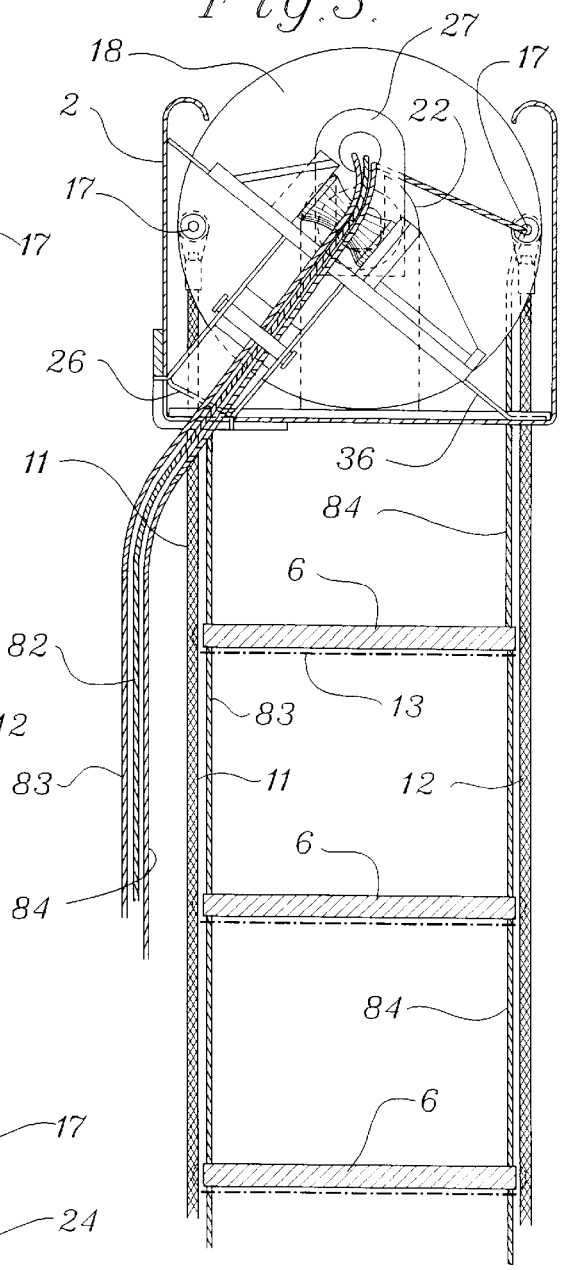
FIG. 3 is a sectional view taken along the line III—III of FIG. 1.
Figure 5:
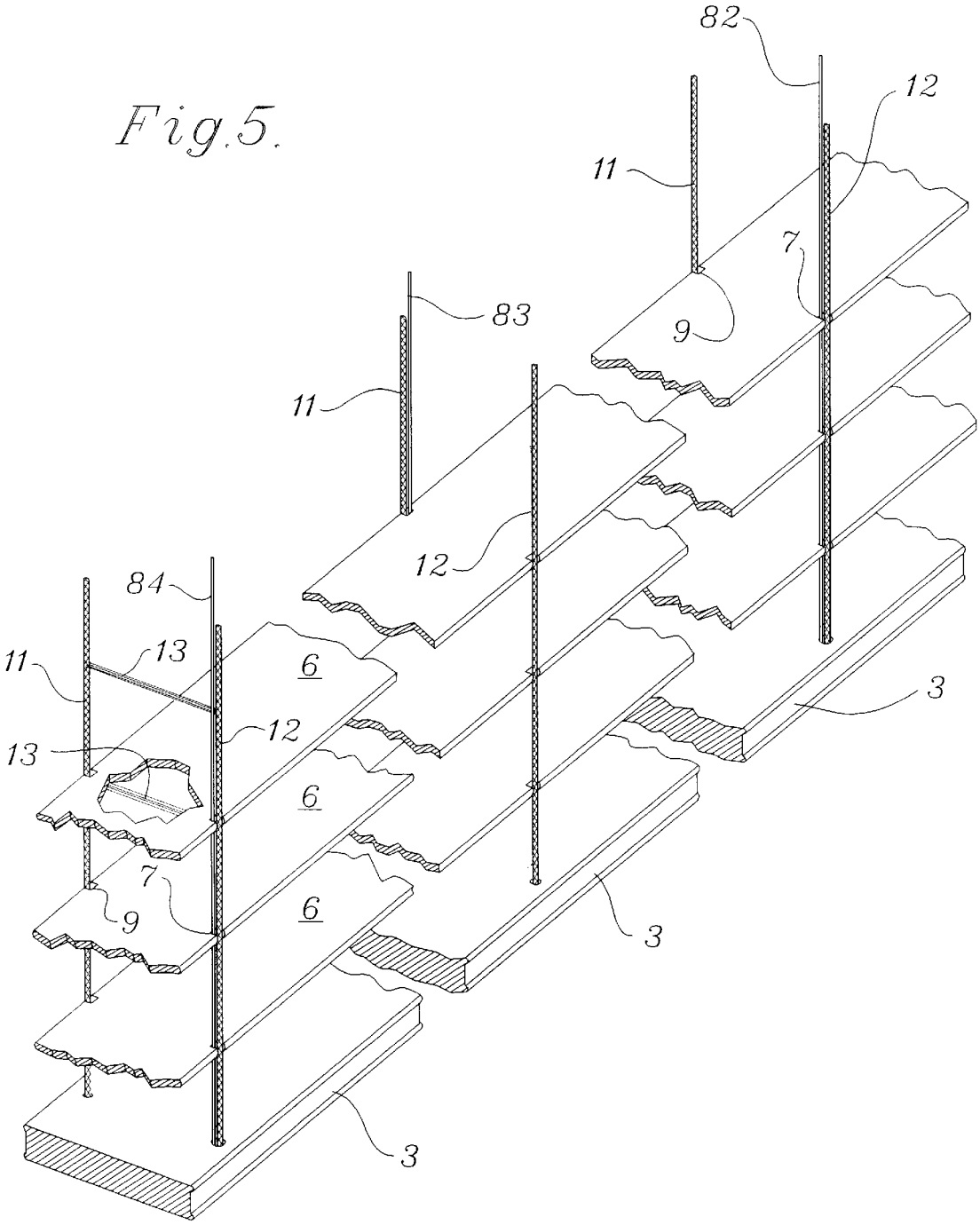
FIG. 5 is a rear perspective view of a portion of the embodiment shown in FIG. 1 taken around the line V—V of FIG. 1 to show the base of a pair of lift cords and adjacent ladder.
Figure 7:
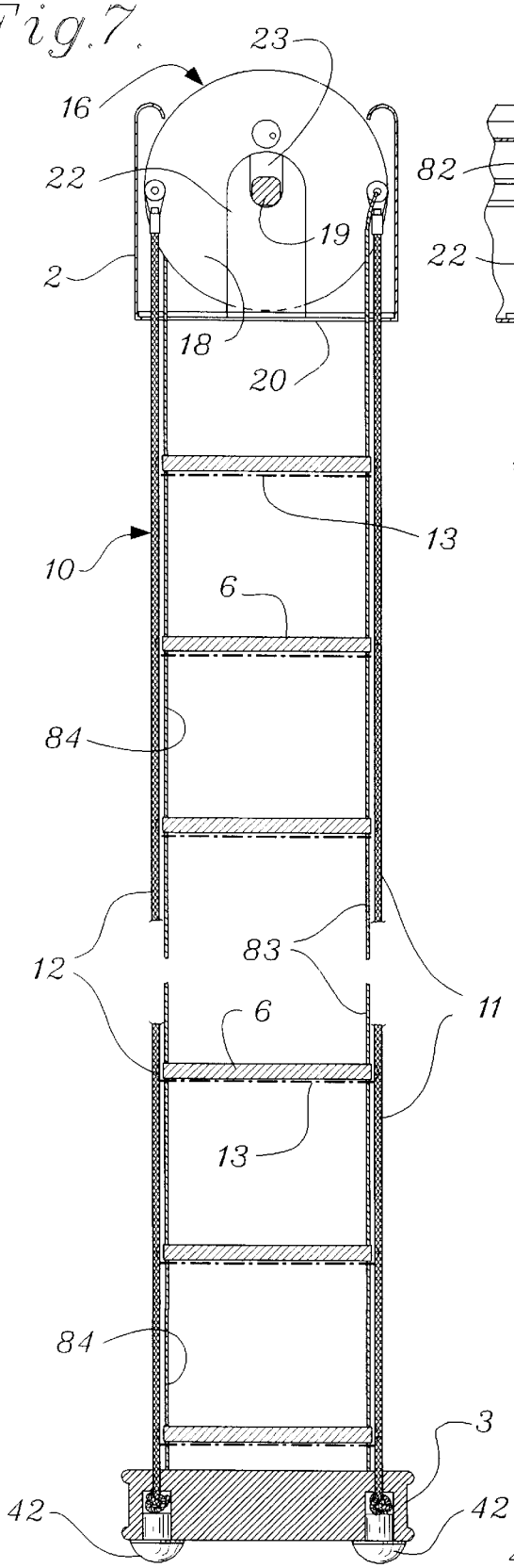
FIG. 7 is a sectional view taken along the line VII—VII in FIG. 1.
Figure 8:
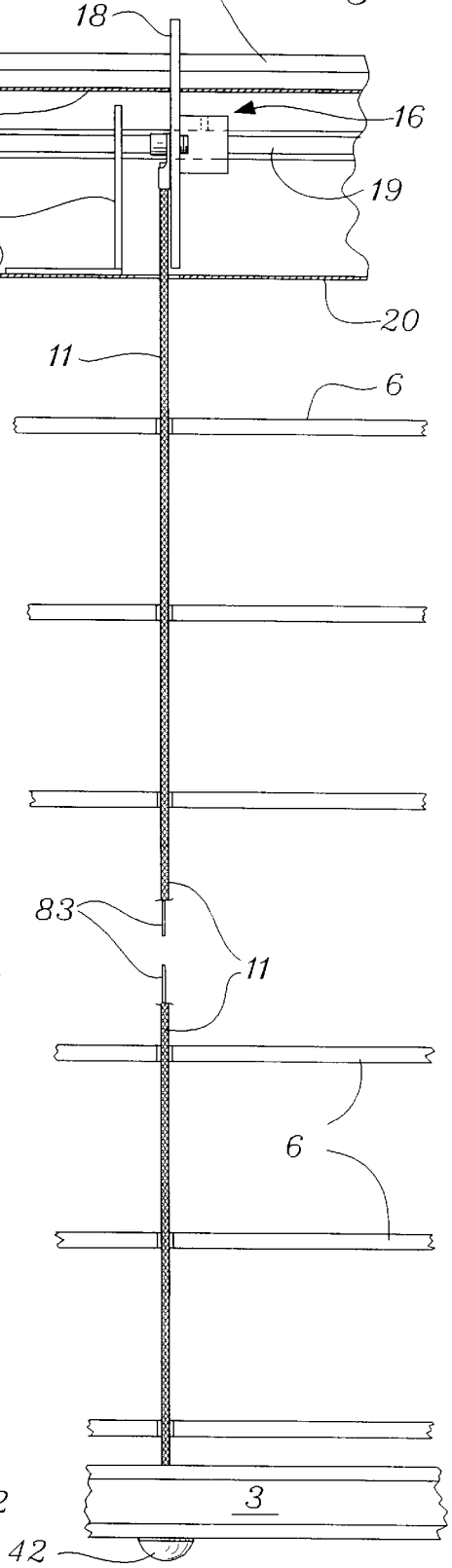
FIG. 8 is a fragmentary view showing the front portion of the blind near the line VII—VII in FIG. 1.

The first present preferred embodiment is comprised of a headrail 2, bottomrail 3 and set of slats 6 extending therebetween. A two piece bottomrail could be used if at least two lift cords are provided at the front and at least two lift cords are provided at the back of the blind. For purposes of illustration only six slats are shown. However, the blind could have any number of slats and likely would have many more slats than are shown. The slats of this embodiment are symmetrical to a horizontal plane passing through the front and back edges of the slat. Crowned slats may be used in place of these flat slats if desired. The slats are suspended on a cord type ladder 10. The ladder has a front rail 11, rear rail 12 and series of rungs 13 extending therebetween on which these slats rest. As shown most clearly in FIG. 7, the bottom ends of the ladders are knotted within the bottomrail 3 and covered by plugs 42. At least one slot 9 is provided on one edge of each slat 6, preferably the front edge of the slats. At least two slots 7 have been cut into the opposite edge of each slat, preferably the back edge of the slats. Three slots are positioned so as not to be opposite one another. Slots can be cut in pairs or not. For ease of manufacture three pairs of opposite slots 7 and 9 could be cut in the slats with only one slot in each pair having a lift cord 82, 83 or 84 as shown in FIG. 5. The slots are sized so that lift cords 82, 83 and 84, and ends of rungs 13 can loosely fit therein. Pairs of slots provide more engagement of the slats by the rungs. Tilt ladders 10 are positioned near the ends of the blind so that one rail 11 or 12 from each ladder is adjacent to one of the three lift cords. Additional ladders may also be provided as shown in FIGS. 1 and 2. For some blinds more than three ladders may be used such that no lift cord is needed at the additional tilt ladders. Slots 7 and 9 preferably have a depth such that only the lift cords 8 and ends of rungs 13 can completely fit therein. Thus, the rails 11 and 12 can never be fully within the slots that also contain lift cords. The lift cords may be alternately laced with the rungs of the adjacent ladder or pass through the rung. For purposes of illustration the lift cords 82, 83 and 84 are shown in chain line in some of the figures so as to distinguish them from the adjacent rails of the tilt ladders or other structures. Because lift cords travel within slots 7 and 9 provided in the slats 6 there are no cord holes in the slats. As can be seen in FIG. 3 the slats 6 rest on rungs 13 of the tilt ladder 10 and can easily be lifted and removed from the rungs for cleaning or repainting.

The number of lift cords that are used will vary according to the size of the blind and the cording arrangement. In every embodiment a lift cord 8 should be positioned near either end of the blind in slots on the same edges, preferably rear edges, of the slats. In the embodiment of FIG. 1 three lift cords extend from the bottomrail through the headrail. As shown most clearly in FIGS. 1 through 6, lift cord 83 extends from the bottomrail 3 through slot 9 in the front edge of slats 6. Lift cords 82 and 84 extend from the bottomrail 3 through slots 7 in the rear edge of slats 6. The lift cords 82, 83 and 84 pass through the headrail 2 exiting on the front right side as shown in FIGS. 1 and 2. The lift cords 82, 83 and 84 are threaded through the headrail over pulley 38 and into a cord lock 26 provided in the headrail 2. I prefer to use a cord lock which always engages the lift cords unless they are being operated. Support plate 36 is provided to attach the cord lock 26 to the headrail 2. The pulley 38 is held in place by support 37. The cords extend through the cord lock to a position outside and at one end of the blinds. preferably, the cord lock is always engaging the lift cords unless the blind is being raised or lowered. The distal end of the lift cords may be tied together in a ball connector 33. If desired a pull cord 34 having a tassel 35 may be connected to the ball connector 33. If the bottomrail is supported by the tilt ladders, as in the embodiment of FIG. 1, the weight of the lift cords extending out of the headrail and the attached tassel can provide sufficient tension to hold the slats in place. Moreover, a weight can be placed in the tassel 35 or connector 33 if needed. If the bottomrail is supported only by the lift cords, the weight of the bottomrail maintains the lift cords in tension. Tension in the lift cord prevents lateral motion of the slats.

Figure 9:
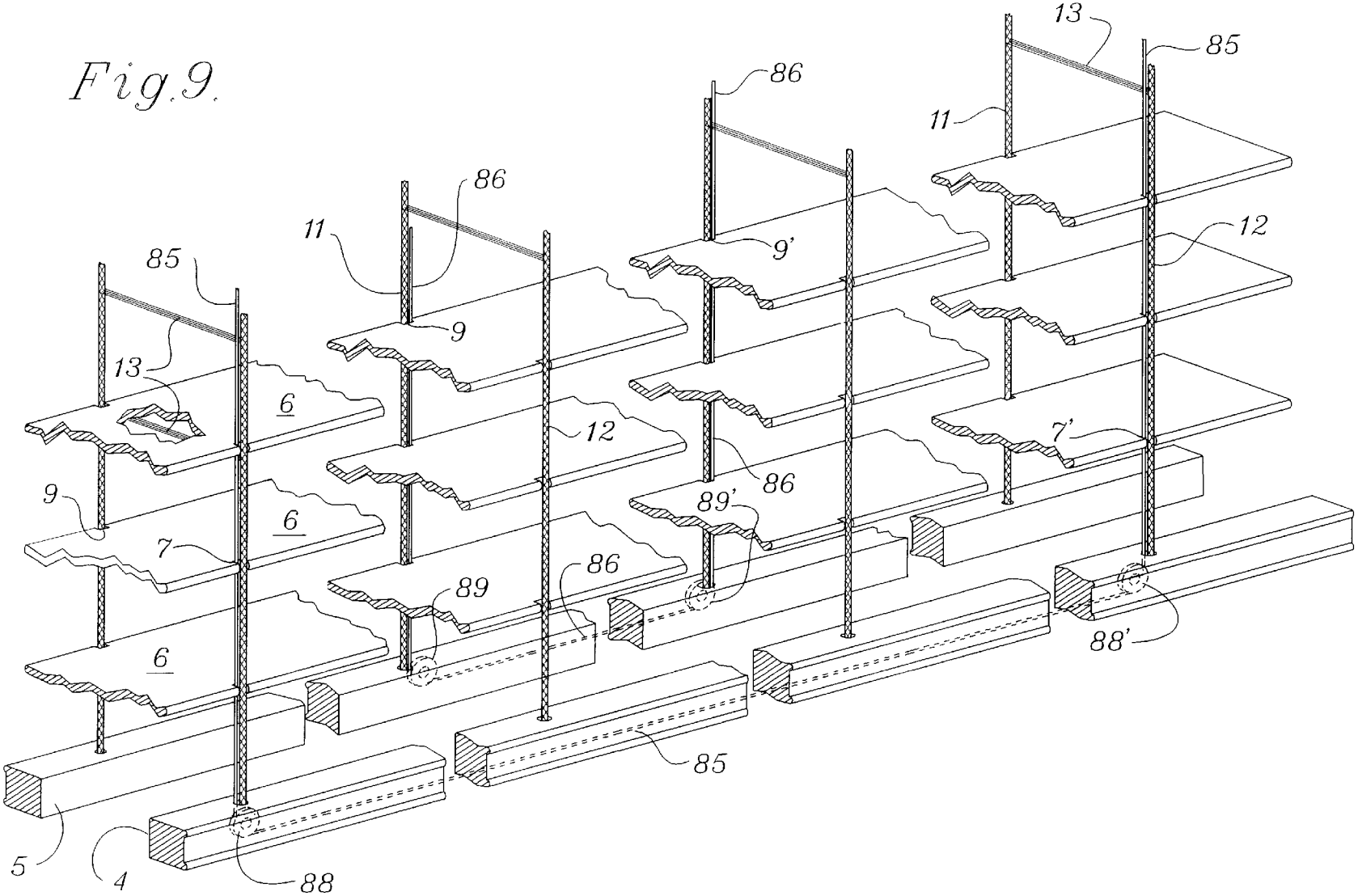
FIG. 9 is a perspective view similar to FIG. 5 showing an alternative routing for the lift cords.
Figure 10:
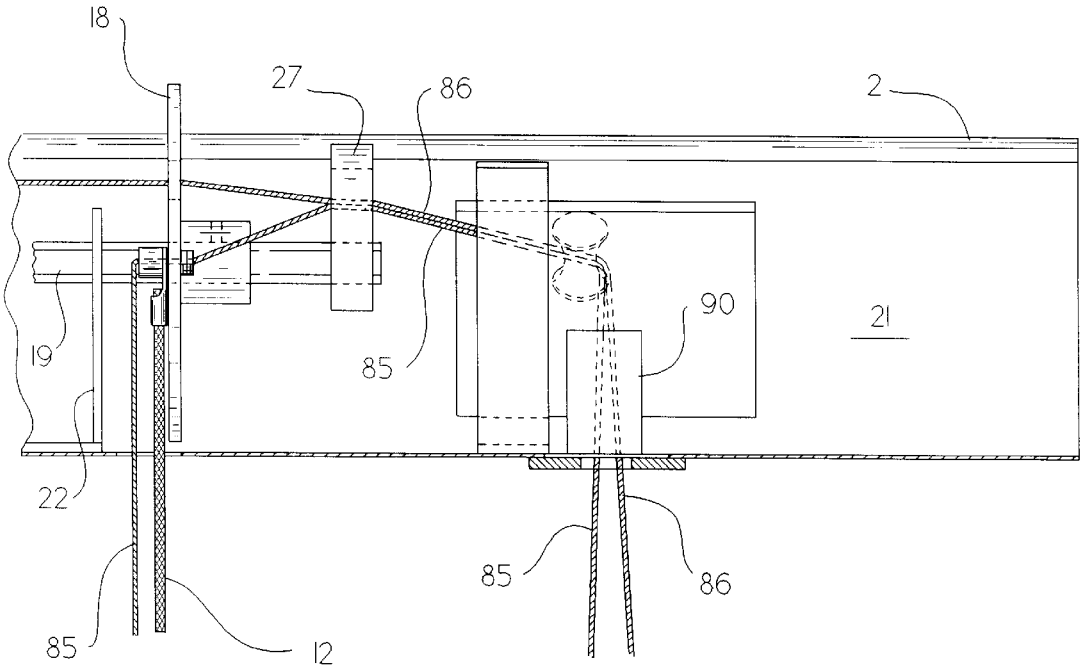
FIG. 10 is a rear view of one end of the headrail with the back panel removed to show the top portion of the alternative lift cord routing of FIG. 9.

An alternative cording arrangement shown in FIGS. 9 and 10 utilizes two lift cords and pulleys in a two piece bottomrail 14. The distal end of each lift cord 85 and 86 is attached to the headrail. Although not shown in the drawings I prefer to make the attachment to a tilt disk 18 at the end of the headrail opposite the cord lock 90. One lift cord 85 is routed from the headrail down the rear of the blind, through the rear slots 7, over pulleys 88, along the rear bottomrail 4, under second pulley 88' and up the rear of the blind through another set of rear slots 7' to the headrail and attached to the disk. Similarly, lift cord 86 is routed from the headrail down the front of the blind, through the front slots 9, over pulley 89, along the front bottomrail 5, under second pulley 89' and up the front of the blind through a second set of front slots 9' to the headrail. The cords 85, 86 pass through a cord lock 90 and out of the headrail as shown in FIG. 10. So that cords 85 and 86 are closer in length, cord 86 may run from the headrail through slots adjacent the first ladder, through the bottomrail, and up through slots adjacent the third ladder while lift cord 85 runs through slots adjacent the second and fourth ladder. One could also provide a pulley arrangement in which each cord goes up and down in the same set of slots. Yet another arrangement would affix one lift cord at the disk away from the cord lock and route it down the front of the blind through a single bottomrail to the other end of that bottomrail, up the back of the blind, and through a cord lock at the other end of the headrail. A second lift cord would follow a similar pattern passing through different sets of slots. In all of those alternate cord routing patterns the lift cords are in tension at all times preventing lateral motion of the slats.

While the lift cords are always in tension, the rails of the tilt ladders are only in tension when the blind is fully lowered. Since the rails are on the outside edges of the slats not in the slots they can fold neatly across the front of the blind when the blind is raised to the position shown in FIG. 2. Although such neat folding generally occurs, I prefer to assure that such neat folding always occurs by treating the rails with a permanent pleating or other treatment to provide a memory in the rails so that they will fold in the desired manner.

Figure 11:
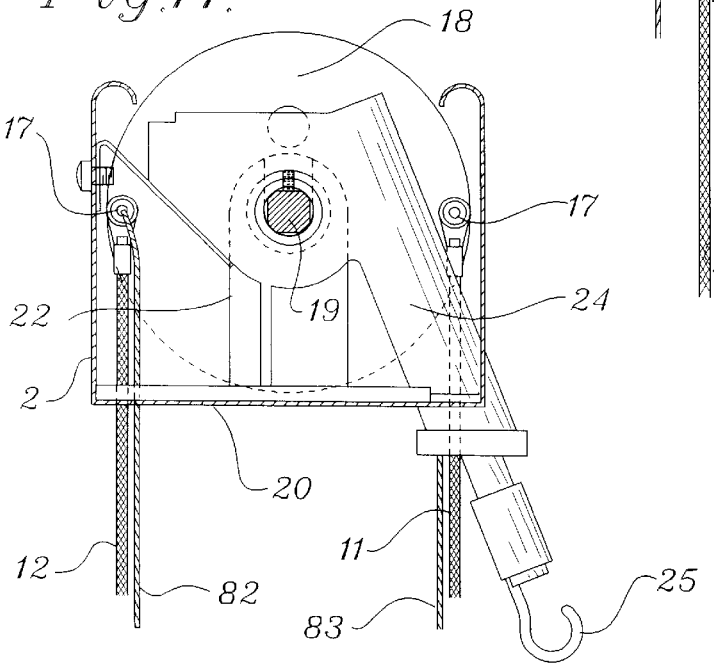
FIG. 11 is a sectional view taken along the line XI—XI of FIG. 1.
Figure 12:
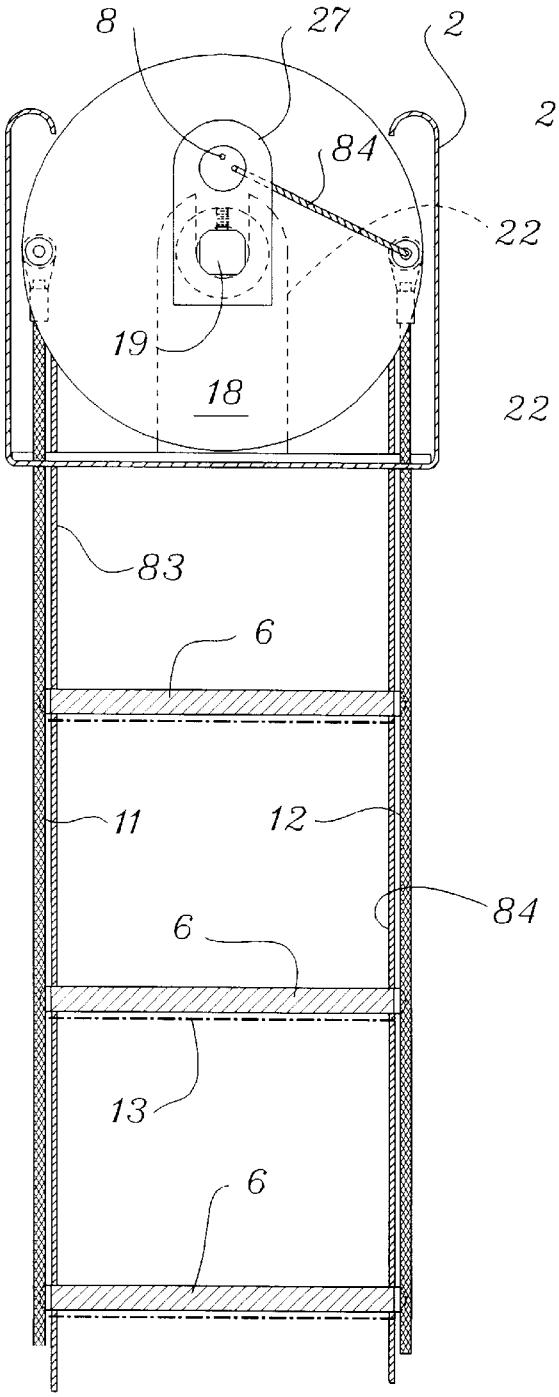
FIG. 12 is a sectional view taken along the line XII—XII of FIG. 1 with the lift cords removed.
Figure 13:
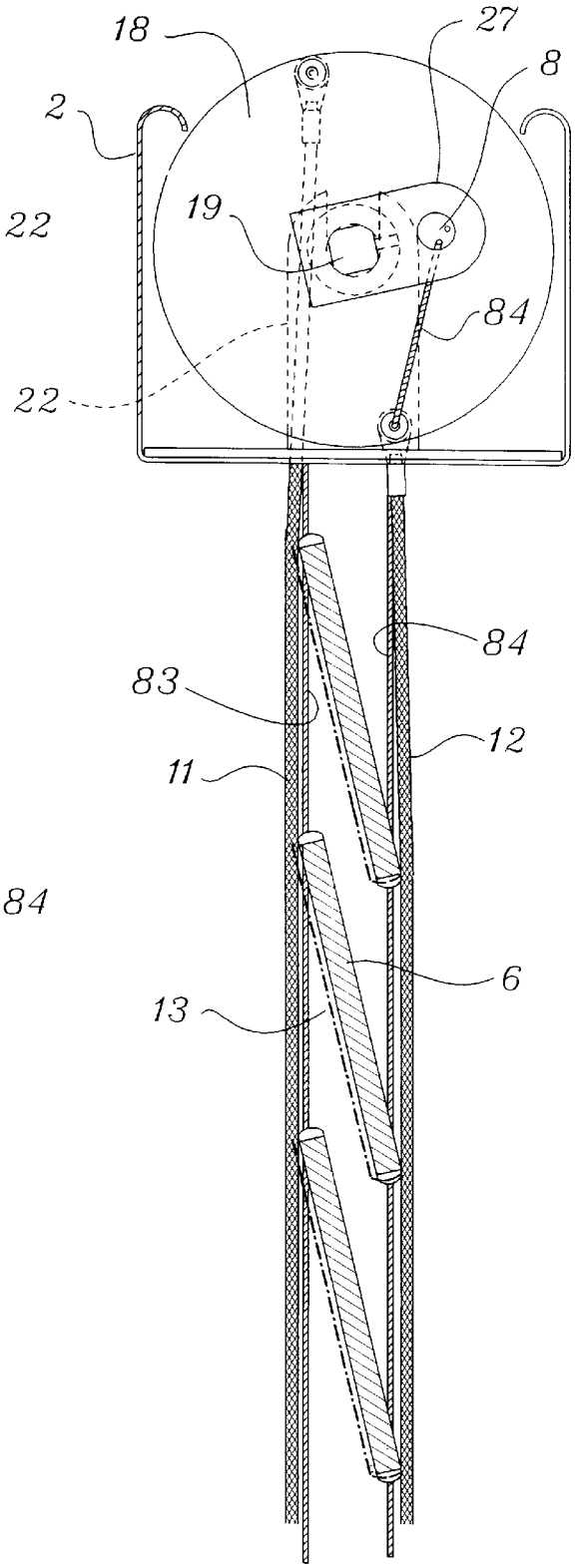
FIG. 13 is a sectional view similar to FIG. 12 showing the blind in a closed position.

A tilt mechanism 16 is provided to move the rails 11 and 12 of the tilt ladder 10 relative to one another to open and close the blind and preferably also moves the lift cords at the same time. The present preferred tilt mechanism can be seen most clearly by referring to FIGS. 3, 4, 7, 8, 11, 12 and 13. The tilt mechanism in the preferred embodiment is comprised of a disk 18 to which the rails 11 and 12 of the tilt ladder 10 are connected. If desired a bar could be used in place of the disk 18. There is one disk for each tilt ladder 10. The disks 18 are mounted on tilt rod 19 so that rotation of the tilt rod will turn the disks in unison. The tilt rod is suspended above the base 20 of the headrail by cradles 22. I prefer to provide a bridge 23 shown in FIG. 7 on each cradle to prevent the lift cords from getting caught on the cradles. As shown in FIG. 11, a right angle drive 24 is provided at one end of tilt rod 19. The drive extends through the headrail 2 to provide a handle 25 which is turned to open and close the blind. Rotation of the disk 18 in either direction lifts one rail 111 or 12 and any associated lift cord relative to the other rail and moves the rails 11 and 12 toward one another. If a two piece bottomrail is used, the front bottomrail will move relative to the rear bottomrail. The same center of gravity should be maintained for the blind through the tilt cycle. The disks can be rotated 100 degrees in either direction from the open position. As can be seen in FIGS. 12 and 13, the blind slats 6 will be in a nearly closed position after the disks 18 have been rotated through approximately 90 degrees. As disks 18 are rotated the lift cords 8 and the rails 11 and 12 of the tilt ladders 10 are constantly in tension. This contains the slats and prevents them from slipping laterally. The number of tilt ladders which are used will vary according to the width of the blind.

Figure 4:
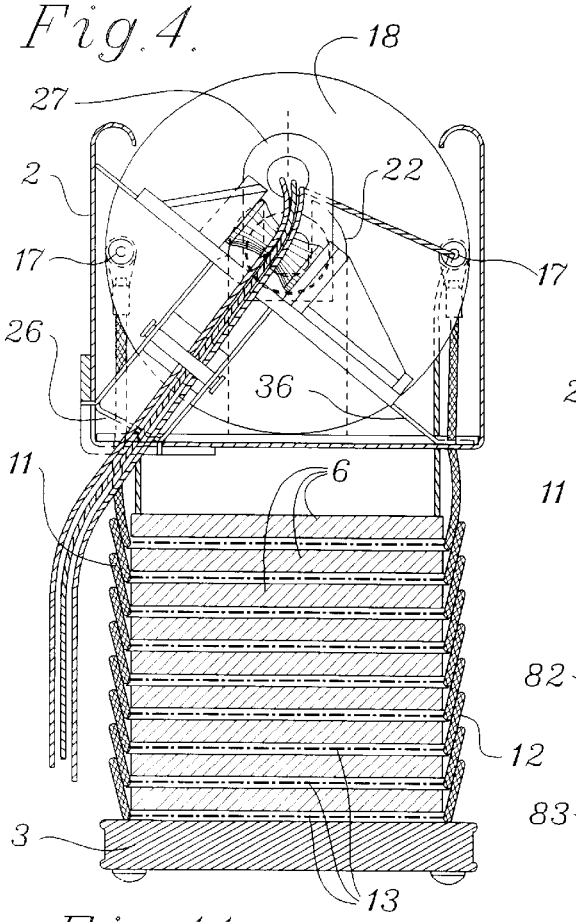
FIG. 4 is a sectional view similar to FIG. 3 taken along the line IV—IV of FIG. 2.
Figure 6:
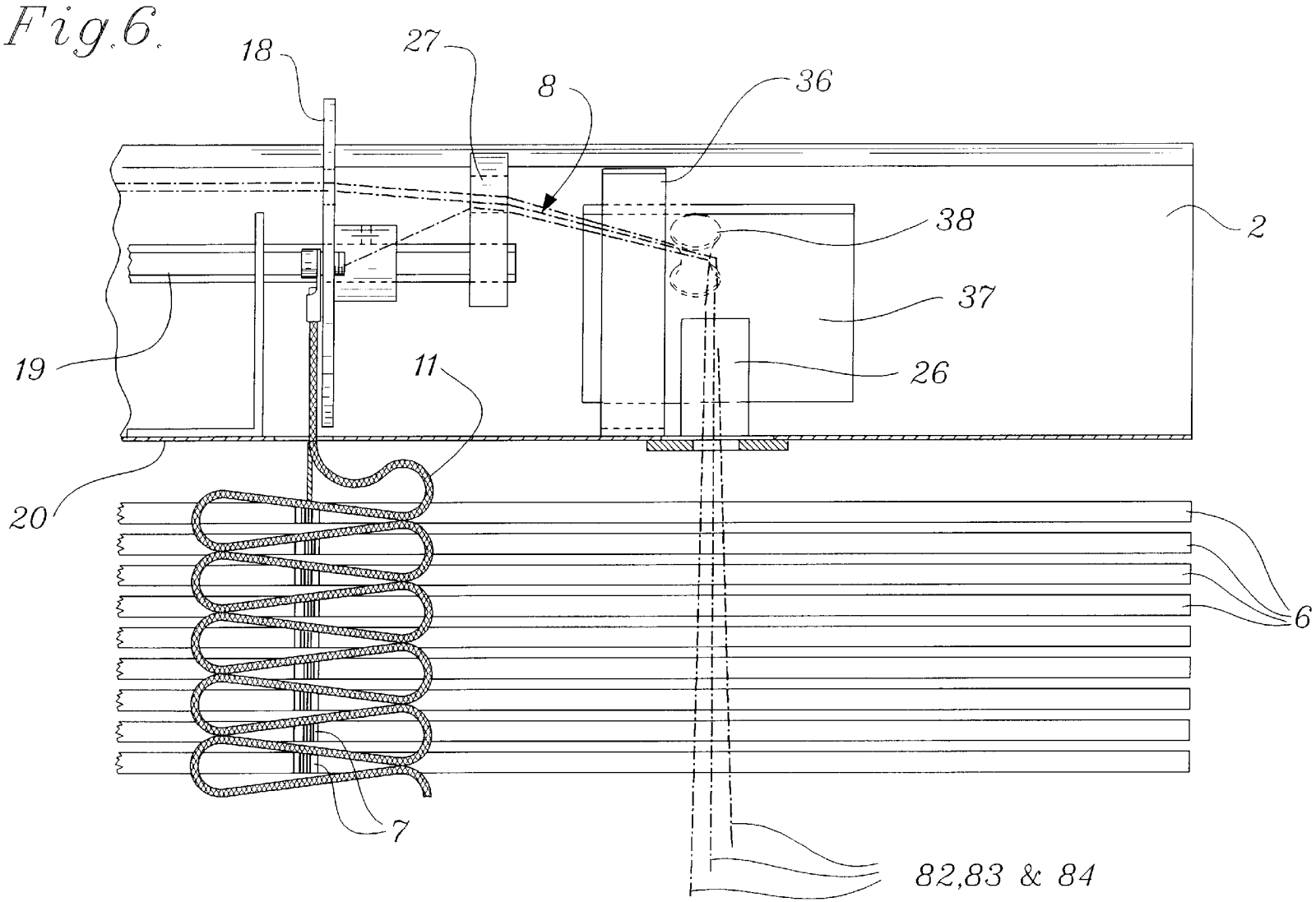
FIG. 6 is a fragmentary view showing the right end of the portion of the raised blind shown in FIG. 2 wherein the front panel of the headrail has been removed.

As can be most clearly seen in FIGS. 3, 4 and 6 the lift cords are routed through pivot holes 17 in the disks 18 located at the point of attachment of the ladder rails 11 and 12 or they may simply be tied off. Consequently, rotation of the disk shifts the lift cords transversely and vertically in tandem with the ladder rails and keeps the lift cords under tension. As shown most clearly in FIGS. 3, 4, 6 and 10, an alignment arm 27 extends from tilt rod 19 through which the lift cords pass to prevent the lift cords from getting caught on the cradles and to present the cords to a pulley 38 for a uniform entry into the cord lock 26 or 90 independent of the tilt angle of the slats. The cords are collected so that they are near the axis of rotation when they leave the tilt frame to go to the cord lock.

Figure 14:
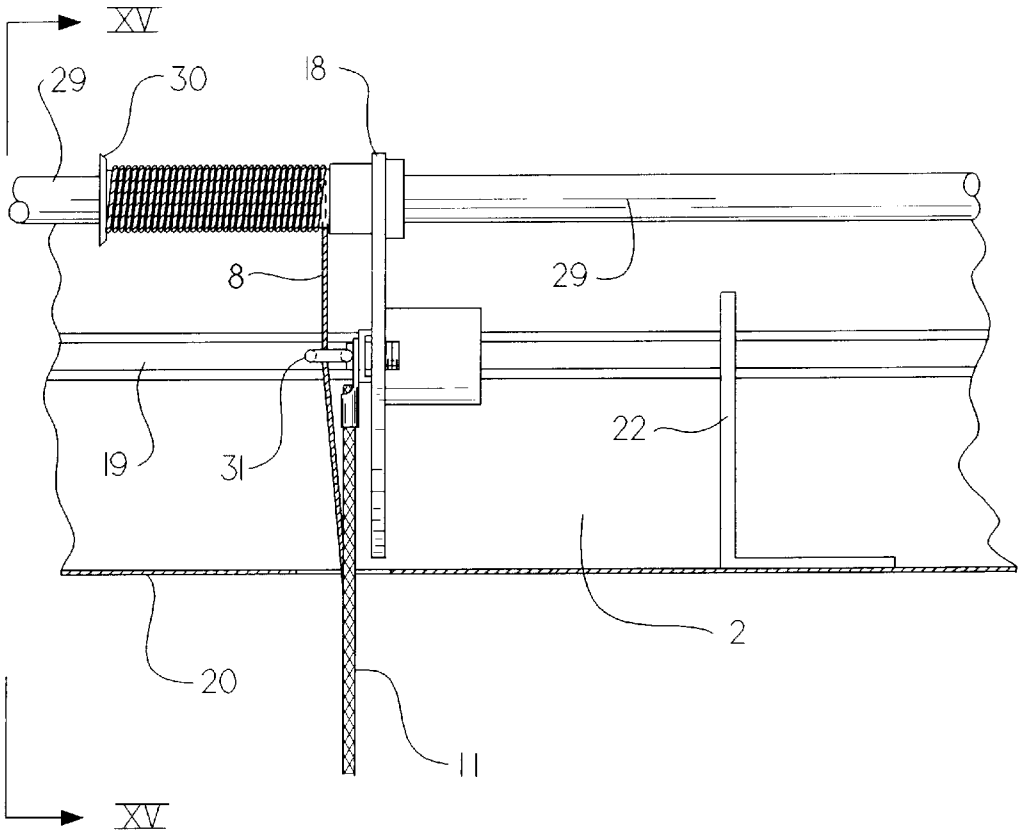
FIG. 14 is a fragmentary view similar to FIG. 6 showing a second preferred embodiment that utilizes a tube lift.
Figure 15:
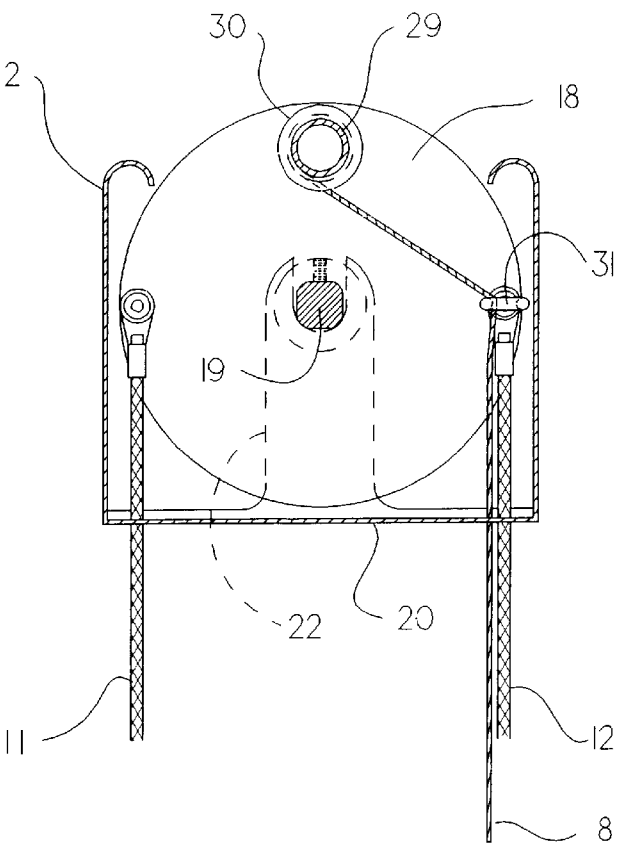
FIG. 15 is a sectional view taken along the line XV—XV of FIG. 14.

In the first preferred embodiment the lift cords 8 pass through the headrail. An alternative is shown in FIGS. 14 and 15 wherein the lift cords are wound about spools 30 attached to an axle 29. The lift cord 8 is guided to the spool by passing through an eye bolt 31 attached to the disk 18. A separate spool is provided for each lift cord 8. Thus, turning of the drive axle 29 will turn all spools raising or lowering all of the lift cords in the front and back of the blind at the same time. A tube lift mechanism such as is disclosed in U.S. Pat. No. 5,184,660 can be adopted for the venetian blind shown in FIGS. 14 and 15.

There are many hardware systems by which the lift cords can be tilted in tandem with the rails of the tilt ladder 10. For example, a set of parallel cradles can be combined with straps or cables and cord locks to form a parallelogram that moves in tandem with the tilt ladder. In another possible arrangement, the disks could be formed as a tilting bar or rotating beam.

Figure 16:
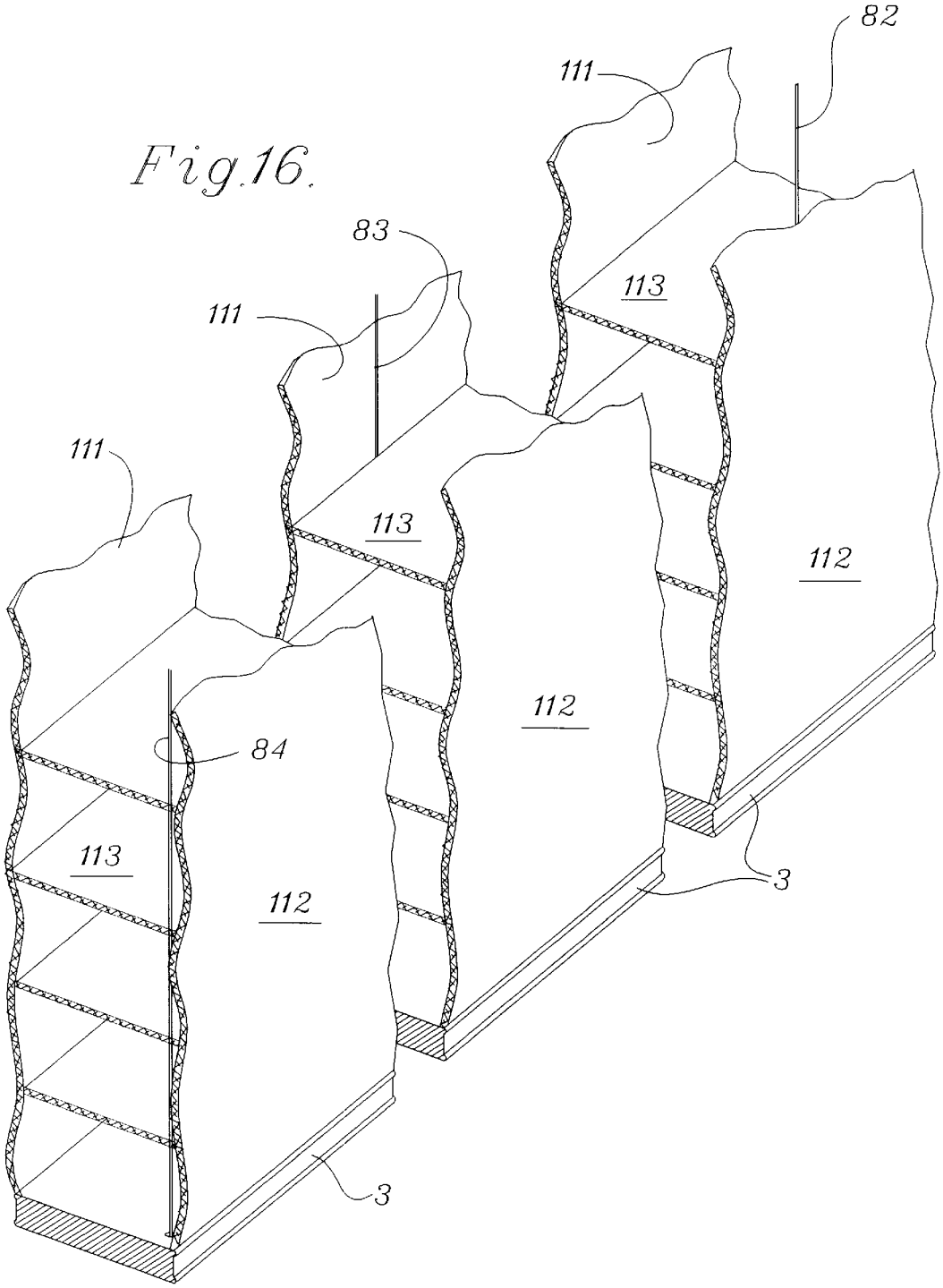
FIG. 16 is a rear perspective view similar to FIG. 5 showing a third preferred embodiment.

Referring to FIG. 16 one could provide inside sheet of fabric 111 and outside sheet of fabric 112 connected by fabric vanes 113 in place of the ladders. Typically, the fabric sheets would be transparent and opaque slats ( not shown) are placed on the fabric vanes 113. If desired, the fabric vanes 113 may be opaque and slats could be omitted as shown in FIG. 16. The cording arrangement is the same as in the first embodiment shown in FIG. 5. One lift cord 83 passes from the bottomrail 3 between the inside sheet 111 and inside edge of the fabric vanes 113 into the headrail (not shown). A pair of spaced apart outside lift cords 82 and 84 passes from the bottomrail 3 between the outside sheet 112 and outside edge of the fabric vanes 113 into the headrail (not shown). The outside lift cords 82 and 84 are positioned so as not to be opposite the inside lift cord 83. This window covering is tilted from an open position shown in FIG. 16 to a closed position by moving the inside sheet 111 and the outside sheet 112 in opposite directions with a tilt mechanism in the headrail. One could also use a double bottomrail and cording shown in FIG. 9 with the sheets of fabric 111 and 112.

In describing the preferred embodiments I identified certain lift cords and fabric sheets as inside or outside. Use of these terms is for ease of reading and should not be understood to limit the configuration or orientation of the window covering. Any structure called inside could be an outside element and any element labeled as outside could be inside.

Because the present blind does not have two lift cords at each ladder where lift cords are present, fewer cords are used. Consequently, simpler cord locks can be used. This blind is easier to fabricate and, therefore, less expensive.

Recent concerns about children becoming entangled in blind cords are also addressed. Fewer lift cords lessens the likelihood of two or more cords becoming twisted into loops in which a child is caught.

Although I have shown and described certain present preferred embodiments of my venetian blind it should be distinctly understood that the invention is not limited thereto but may be variously embodied within the scope of the following claims.

I claim:

1. A venetian type blind comprising:

a bottomrail;

a plurality of slats above the bottomrail, each slat having an inside edge and an outside edge and at least two spaced apart outside slots on the outside edge and at least one inside slot on the inside edge positioned so that the at least one inside slot is not opposite either slot on the outside edge, the outside slots being laterally spaced apart from the at least one inside slot;

a first ladder having opposite cord type rails and rungs extending therebetween, one rail positioned near one of the two inside slots and connected to the bottomrail;

a first lift cord adjacent to the one rail of the first ladder, and connected to the bottomrail, and running through one outside slot, there being no lift cord adjacent the opposite rail of the first ladder;

a second ladder having opposite cord type rails and rungs extending therebetween, one rail positioned near another of the outside slots and connected to the bottomrail;

a second lift cord adjacent to one rail of the second ladder, and connected to the bottomrail, and running through the another of the outside slots, there being no lift cord adjacent the opposite rail of the second ladder;

a third ladder having opposite cord type rails and rungs extending therebetween, one rail positioned near the at least one inside slot and connected to the bottomrail;

a third lift cord adjacent to one rail of the third ladder, and connected to the bottomrail, and running through the at least one inside slot, there being no lift cord adjacent the opposite rail of the third ladder;

a headrail above the bottomrail and the plurality of slats through which the lift cords pass; and a tilt mechanism attached to the headrail to which tilt mechanism at least the first, second and third ladders are attached wherein the tilt mechanism moves the rails of the ladders in opposite directions at the tilt mechanism and adjacent the slats when the blind is changed from an open position to a closed position.

2. The venetian blind of claim 1 wherein at least one of the lift cords is alternately laced with the rungs of the adjacent ladder.

3. The venetian blind of claim 1 wherein at least one of the lift cords passes through at least one rung of one of the ladders.

4. The venetian blind of claim 1 wherein the lift cords are connected to the tilt mechanism and the tilt mechanism moves rails of the ladders and the lift cords together at the tilt mechanism and adjacent the slats when the blind is changed from an open position to a closed position.

5. The venetian type blind of claim 1 wherein the lift cords have a diameter smaller than a diameter of the rails of the ladders.

6. The venetian type blind of claim 1 also comprising a tube lift attached to the headrail and to which the lift cords are connected.

7. The venetian type blind of claim 1 wherein the slots have a depth substantially equal to a diameter of the lift cords.

8. The venetian type blind of claim 1 also comprising at least one weight attached to at least one lift cord.

9. The venetian type blind of claim 1 also comprising a cord lock through which the lift cords pass.

10. The venetian type blind of claim 9 wherein the cord lock is always engaged unless the lift cords are being operated.

11. A venetian type blind comprised of:

an inside bottomrail and an outside bottomrail spaced apart from and parallel to the inside bottomrail;

a plurality of slats above the bottomrails, each slat having an inside edge and an outside edge and at least two spaced apart outside slots on the outside edge and at least one inside slot on the inside edge positioned so that the at least one inside slot is not opposite either slot on the outside edge, the outside slots being laterally spaced apart from the at least one inside slot;

a first ladder having opposite cord type rails and rungs extending therebetween, one rail positioned near one of the two inside slots and connected to the bottomrails;

a first lift cord adjacent to the one rail of the first ladder, and connected to the outside bottomrail, and running through one outside slot, there being no lift cord adjacent the opposite rail of the first ladder;

a second ladder having opposite cord type rails and rungs extending therebetween, one rail positioned near another of the outside slots and connected to the bottomrails;

a second lift cord adjacent to one rail of the second ladder, and connected to the outside bottomrail, and running through the another of the outside slots, there being no lift cord adjacent the opposite rail of the second ladder;

a third ladder having opposite cord type rails and rungs extending therebetween, one rail positioned near the at least one inside slot and connected to the bottomrails;

a third lift cord adjacent to one rail of the third ladder, and connected to the inside bottomrail, and running through the at least one inside slot, there being no lift cord adjacent the opposite rail of the third ladder;

a headrail above the bottomrail and the plurality of slats through which the lift cords pass; and a tilt mechanism attached to the headrail to which tilt mechanism at least the first, second and third ladders are attached wherein the tilt mechanism moves the rails of the ladders in opposite directions at the tilt mechanism and adjacent the slats when the blind is changed from an open position to a closed position.

12. A venetian type blind comprised of:

a bottomrail;

a plurality of slats above the bottomrail, each slat having an inside edge and an outside edge and at least two spaced apart outside slots on the outside edge and at least one inside slot on the inside edge positioned so that the at least one inside slot is not opposite either slot on the outside edge, the outside slots being laterally spaced apart from the at least one inside slot;

a first ladder having opposite cord type rails and rungs extending therebetween, one rail positioned near one of the two inside slots and connected to the bottomrail;

a first lift cord adjacent to the one rail of the first ladder, and connected to the bottomrail, and running through one outside slot, there being no lift cord adjacent the opposite rail of the first ladder;

a second ladder having opposite cord type rails and rungs extending therebetween, one rail positioned near another of the outside slots and connected to the bottomrail;

a second lift cord adjacent to one rail of the second ladder, and connected to the bottomrail, and running through the another of the outside slots, there being no lift cord adjacent the opposite rail of the second ladder;

a third ladder having opposite cord type rails and rungs extending therebetween, one rail positioned near the at least one inside slot and connected to the bottomrail;

a third lift cord adjacent to one rail of the third ladder, and connected to the bottomrail, and running through the at least one inside slots, there being no lift cord adjacent the opposite rail of the third ladder;

a headrail above the bottomrail and the plurality of slats through which the lift cords pass; and a tilt mechanism attached to the headrail, the tilt mechanism comprised of:

a first disk to which the rails of the first ladder are attached;

a second disk to which the rails of the second ladder are attached;

a third disc to which the rails of the third ladder are attached;

an axle attached between the first disk, the second disk and the third disk; and means for rotating the axle and attached disks.

13. The venetian type blind of claim 12, wherein at least one of the lift cords passes through at least one of the first disk and the second disk.

14. The venetian type blind of claim 12 wherein the means for rotating the axle and attached disks is a right angle drive.

15. A venetian type blind comprising:

a bottomrail;

a headrail above the bottomrail;

an inside sheet of fabric extending between the headrail and the bottomrail;

an outside sheet of fabric extending between the headrail and the bottomrail;

a plurality of spaced apart, parallel vanes extending between the inside sheet of fabric and the outside sheet of fabric, each vane having an inside edge adjacent the inside sheet of fabric and an outside edge adjacent the outside sheet of fabric;

at least one inside lift cord passing between the inside sheet of fabric and the inside edges of the vanes and running the headrail;

at least a pair of spaced apart outside lift cords passing between the outside sheet of fabric and the outside edges of the vanes and running the headrail , the outside lift cords positioned so as not to be directly opposite any inside lift cord;

a tilt mechanism attached to the headrail, the inside sheet of fabric and the outside sheet of fabric, wherein the tilt mechanism moves the inside sheet and the outside sheet in opposite directions when the blind is changed from an open position to a closed position.

16. The venetian type blind of claim 15 wherein the inside sheet of fabric and the outside sheet of fabric are translucent.

17. The venetian type blind of claim 15 wherein the vanes are opaque.

* * * * *